United States Patent [19]

Emmerich

[11] 4,026,605

[45] May 31, 1977

[54] MINING TOOL

[75] Inventor: Kenneth C. Emmerich, Lexington, Ky.

[73] Assignee: Fansteel Inc., N. Chicago, Ill.

[22] Filed: Jan. 6, 1976

[21] Appl. No.: 646,905

[52] U.S. Cl. ..... 299/92; 285/DIG. 7; 285/303; 285/317; 85/5 B; 403/108; 403/328; 175/354; 175/374

[51] Int. Cl.[2] ..... E21C 13/00

[58] Field of Search ..... 299/92, 86, 91; 85/5 B; 151/9, 48; 285/303, 317, DIG. 7; 175/354, 413; 137/142 A

[56] References Cited

UNITED STATES PATENTS

| | | | |
|---|---|---|---|
| 1,234,455 | 7/1917 | Fox | 403/53 X |
| 1,422,067 | 7/1922 | Abegg | 85/5 B |
| 1,572,142 | 2/1926 | Hood | 403/328 X |
| 2,583,786 | 1/1952 | Marzucco | 403/108 X |
| 2,758,625 | 8/1956 | Poupitch | 151/9 X |
| 2,851,295 | 9/1958 | Chaffee | 299/92 X |
| 3,499,685 | 3/1970 | Kniff | 299/92 X |

FOREIGN PATENTS OR APPLICATIONS

| | | | |
|---|---|---|---|
| 1,470,059 | 1/1967 | France | 299/92 |
| 939,370 | 10/1963 | United Kingdom | 299/92 |

*Primary Examiner*—Ernest R. Purser
*Assistant Examiner*—Richard E. Favreau
*Attorney, Agent, or Firm*—Barnes, Kisselle, Raisch & Choate

[57] ABSTRACT

An improvement in mining tools of the rotary and replaceable type which includes a retainer in the form of a double ball spring detent to provide axial retention, easy removability, and to permit ready rotation of the tool in a collet while preventing the build up and impaction of dust which will inhibit rotation or removal.

4 Claims, 11 Drawing Figures

MINING TOOL

This invention relates to a Mining Tool and more particularly to that type of tool which is used in rock and coal mining. These tools have a hard cutting end which cuts into the material to be mined.

BACKGROUND AND ADVANTAGES OF THE INVENTION

The tools are usually mounted in a machine which has a rotary cutter wheel from the circumference of which the tools project, or in a chain drag device which carries the points of the tools into contact with the rock or coal. An example of a tool of this general type is found in the disclosure of the U.S. Patent to Krekeler, U.S. Pat. No. 3,331,637, dated July 18, 1967.

Since these tools wear very rapidly, it is important that it be possible to change them readily. They are subject to heavy percussion in their use and any retainer must be such that it will stand up to the rugged conditions. It is also important from the point of view of tool life that the tools be mounted to rotate in the retaining socket. This results in more even wear of the cutting points and insures a longer tool life.

Since the tools are operating in heavy abrasive dust, it is also important that any retaining device be such that it will not become impacted to prevent removal and it should be such that dust will not destroy its effectiveness.

Many retaining devices have been used for mining tools in the form of spring clips, cross pins driven in to a transverse hole, rubber mounted retainers and so forth. Most of these retainers have been mounted on the socket of a tool although some circular retainer rings have been carried in a groove in the end of a tool shank.

The search for a better retainer has, however, continued in an effort to find a device which would provide a better solution to the various problems which arise in use.

The present invention is directed to a structure which is relatively simple, once disclosed, but which has eluded the designers of mining tools even though it was right in front of them in the fastening art. One can surmise that designers have assumed or concluded that the device to be disclosed would not work. However, the inventor of the present structure to be disclosed has jumped the hurdle of conventional thought and has devised a retainer in the form of a double ball spring pressed device which provides many advantages.

The invention permits quick removal and insertion and thus reduces expensive set-up time. The bit and retainer are self-contained so that an inventory of separate retainer parts need not be retained. The device allows free rotation of the bit in the holding block or collet and is clear at the back so dust and cuttings cannot pack in around the back side of the tool. The device is also inexpensive to manufacture and any replacement of worn parts can be readily accomplished when necessary.

The bit has also produced some startling results in the field testing. In addition to the above advantages, it has almost doubled the tool life, thus providing a great savings to the user not only in bit cost but in reduction of down time.

BRIEF DESCRIPTION

The device consists of a double ball detent provided at the back end of a tool bit with a simple spring pressing outward against the balls which are retained by a formed lip slightly smaller than the diameter of the balls. The balls are hardened to provide good wear characteristics and in some embodiments are retained in a sleeve cartridge which is driven into a suitably sized hole in the tool shank.

DETAILED DISCLOSURE OF THE INVENTION

It should be stated at the outset that a double ball retainer in other arts is known in such U.S. patents as Fox U.S. Pat. No. 1,234,455 (1917) and Walker U.S. Pat. No. 1,772,723 (1929). The invention in the present disclosure lies in the adaptation of this type of retainers to the mining art after many years of struggling with other retainers which have presented difficulties.

Figure 1:
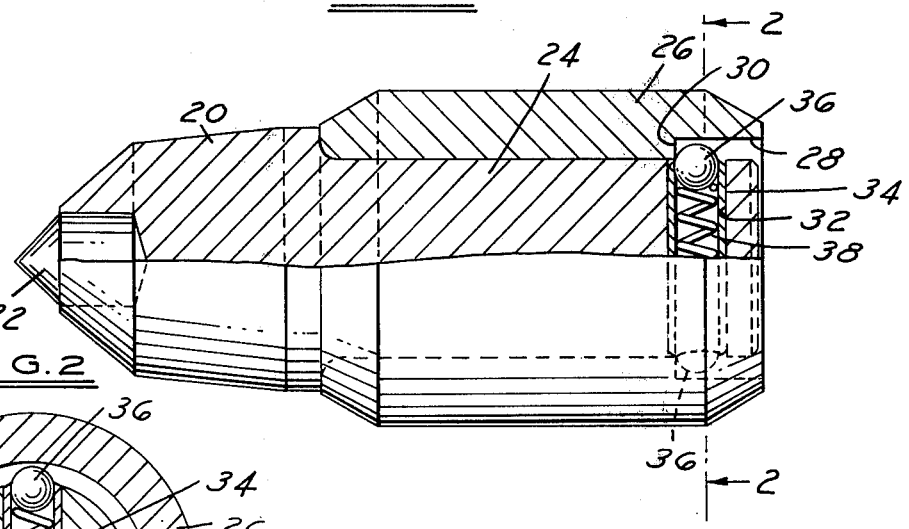
FIG. 1, is a view of a tool assembly.
Figure 2:
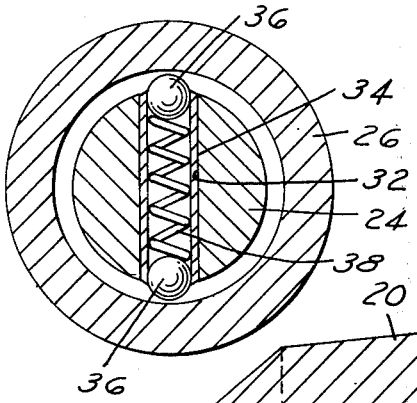
FIG. 2, an end view, from the right, of FIG. 1.

FIG. 1 illustrates the invention as utilized in a rotating mining tool 20 having a tip 22 of sintered tungsten carbide and a mounting shank 24 carried in a collet 26 or other suitable mounting device common in power driven mining machines.

The mounting device 26 has an annular recess 28 at the rear end terminating in a shoulder 30. It will be appreciated that the retainer would be equally effective if the mounting device terminated at the shoulder. A shoulder 31 on tool 20 carries the axial load of the tool.

Figure 3:
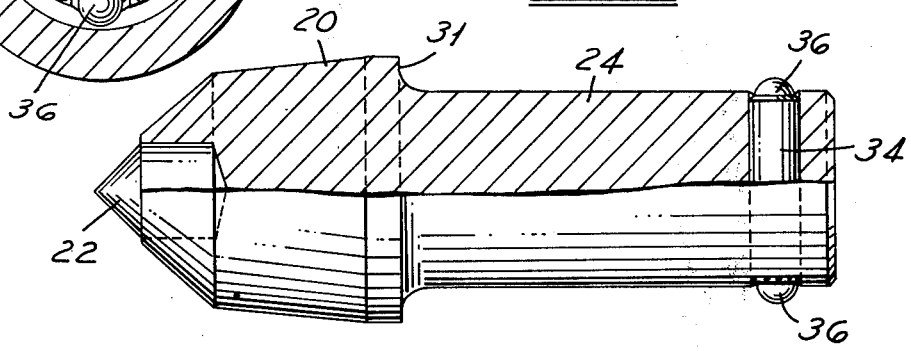
FIG. 3, a view of the tool removed from a retainer.
Figure 4:
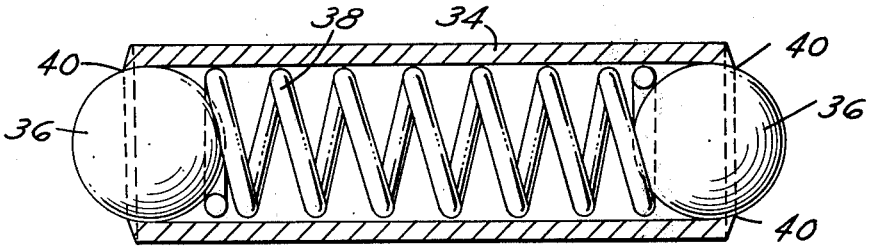
FIG. 4, a section of a ball retainer.
Figure 5:
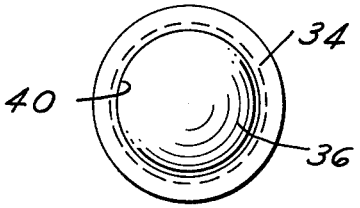
FIG. 5, an end view of the retainer sleeve.
Figure 6:
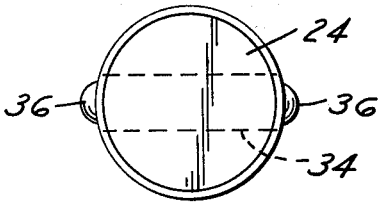
FIG. 6, an end view of the assembled retainer in a tool shank.

The shank 24, FIGS. 3 and 4, is provided with a transverse diametrical passage 32 into which is pressed a tube 34. The tube, FIGS. 4 and 5, has a press fit in the passage 32. The tube 34 has a ball 36 backed by a common spring 38. Each end of the tube is spun in at 40 to provide a retaining lip having an inner diameter slightly smaller than the diameter of the balls 36. The balls project outwardly, FIG. 6, substantially beyond the outer diameter of the shank 24 so that they can contact and be retained by the shoulder 30.

It will be seen that the tool shank can be easily driven into or out of the retainer 26 but that the balls 36 will permit rotation of the tool shank 24 and cause them to clear the dust and chips from the end of the mounting device 26. The balls serve to facilitate the rotation of the shank in the holder and, due to their location, serve to sweep the end of the mounting device to dislodge any foreign matter before it becomes impacted. The tool shank is thus retained axially by the shoulder 31 acting on the end of the mounting device 26 and the balls 36.

Figure 7:
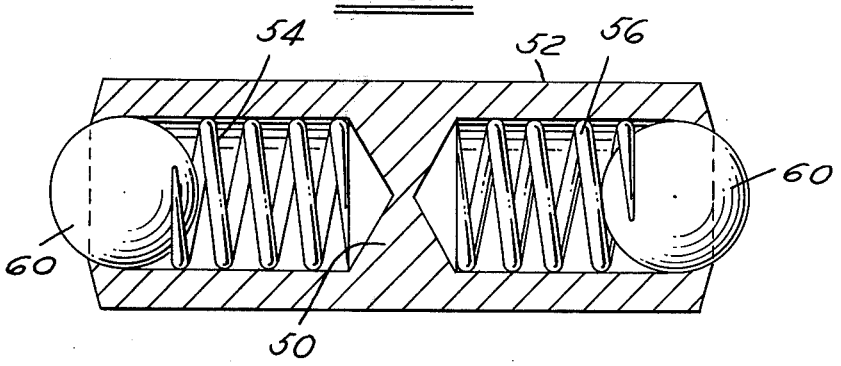
FIG. 7, a view of a modified ball retainer.
Figure 8:
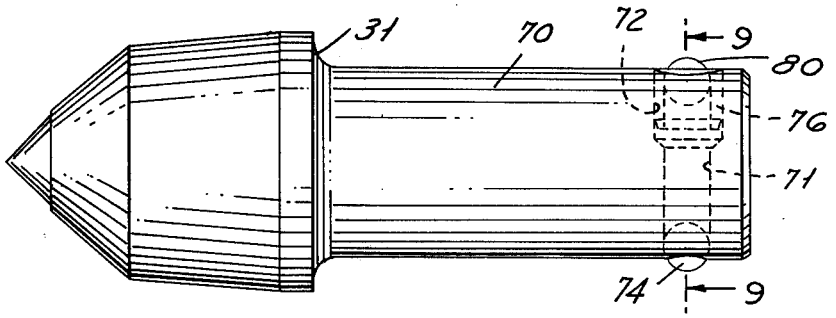
FIG. 8, a view of a tool shank with a further modified retainer structure.
Figure 9:
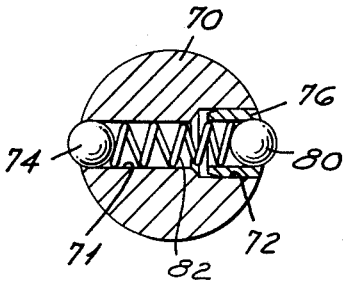
FIG. 9, a sectional view of the retainer structure of FIG. 8 taken on line 9—9 of FIG. 8.
Figure 10:
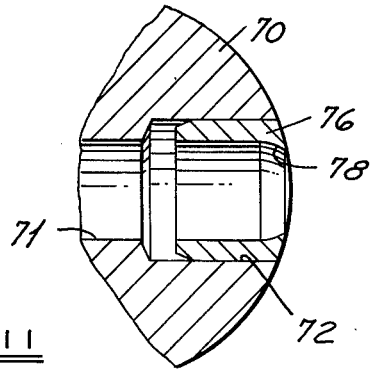
FIG. 10, an enlarged view of one end of the retainer of FIGS. 8 and 9.
Figure 11:
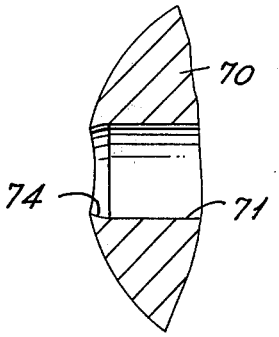
FIG. 11, an enlarged view of the other end of the retainer of FIGS. 8 and 9.

In FIG. 7, a modified structure is shown in which a septum 50 is provided in an insertion tube 52 to provide a backing for separate springs 54, 56 backing up balls 60.

In FIGS. 8 to 11, a second modified structure is shown in which a stepped bore transverse of the shank 70 has a small section 71 and a larger section 72. The small section terminates in an ensmalled lip 74, FIG. 11. to retain a ball 74. The enlarged section 72 receives a short retainer tube 76 which has an outer lip 78 (FIG. 10) to retain ball 80. A spring 82 is inserted prior to the pressing in of retainer 76.

It will thus be seen that there is disclosed a new retainer system for mining tools previously unappreciated and shunned by mining tool designers and yet which has significant unappreciated advantages peculiar to the mining field.

What I claim is:

1. A mining tool comprising a tool head having a hard cutting insert at one end and a mounting shank at the other end to be rotatably received and retained in a cylindrical recess of a mounting device, said head having a shoulder at the cutting end to carry axial load, and a retaining device at the other end comprising a transverse hole in said shank, a spring retained in said hole, at least one ball in said hole backed by said spring and means at the outer end of said hole to retain said ball in an equatorial region, said ball having a projecting portion to contact a portion of the cylindrical recess to retain said shank against axial dislodgment while permitting rotation of said shank.

2. A mining tool comprising a tool head having a hard cutting insert at one end and a mounting shank at the other end to be rotatably received and retained in a cylindrical recess of a mounting device, said head having a shoulder at the cutting end to carry axial load, and a retaining device at the other end comprising a transverse, diametrical hole in said shank, a ball in each end of said hole, spring means between said balls urging them outwardly, and means at each end of said hole to retain said balls in an equatorial region, said ball having a projecting portion to contact a portion of the cylindrical recess to retain said shank against axial dislodgment while permitting rotation of said shank.

3. In combination a mining tool mount having a cylindrical opening with a radial shoulder at each end, a mining tool shank to be retained in said opening having a shoulder to engage a shoulder at one end of said mount to take axial thrust, and a retaining means in said shank at the other of said opening comprising a cylindrical tube in a transverse diametrical hole in said shank, a retainer ball at each end of said tube retained by a lip on the end of said tube, and a spring captive between said balls to urge said balls outwardly for engagement with a shoulder at the other end of said mount, wherein said shank can rotate freely on said cylindrical opening.

4. A mining tool comprising a tool head having a hard cutting insert at one end and a mounting shank at the other end to be received in a cylindrical recess of a mounting device, said head having a shoulder at the cutting end to carry axial load, and a retaining device at the other end comprising a transverse, diametrical hole in said shank, a ball in each end of said hole, spring means between said balls urging them outwardly, and means at each end of said hole to retain said balls in an equatorial region, said tube being press fitted in said hole and the means to retain said balls in said tube comprising a restricted lip at the ends of said tube having an inner diameter slightly smaller than the equatorial diameter of said balls.

* * * * *